US009244479B2

(12) United States Patent
Willey

(10) Patent No.: US 9,244,479 B2
(45) **Date of Patent: *Jan. 26, 2016**

(54) CURRENT GENERATOR CIRCUIT AND METHODS FOR PROVIDING AN OUTPUT CURRENT

(71) Applicant: MICRON TECHNOLOGY, INC., Boise, ID (US)

(72) Inventor: Aaron Willey, Burlington, VT (US)

(73) Assignee: Micron Technology, Inc., Boise, ID (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/448,444

(22) Filed: Jul. 31, 2014

(65) Prior Publication Data

US 2014/0340069 A1 Nov. 20, 2014

Related U.S. Application Data

(63) Continuation of application No. 12/872,854, filed on Aug. 31, 2010, now Pat. No. 8,829,882.

(51) Int. Cl.

| | |
|---|---|
| ***G05F 3/22*** | (2006.01) |
| ***G05F 3/26*** | (2006.01) |
| ***G05F 3/20*** | (2006.01) |

(52) U.S. Cl.

CPC . *G05F 3/262* (2013.01); *G05F 3/20* (2013.01)

(58) Field of Classification Search

CPC ..... G06F 3/20; G06F 3/22

USPC ..... 323/282, 285, 288, 311, 312, 313, 314, 323/315, 317

See application file for complete search history.

(56) References Cited

U.S. PATENT DOCUMENTS

| | | | | |
|---|---|---|---|---|
| 4,714,900 | A | 12/1987 | Sata | |
| 5,798,669 | A | 8/1998 | Klughart | |
| 5,847,556 | A | 12/1998 | Kothandaraman et al. | |
| 5,864,228 | A | 1/1999 | Brown et al. | |
| 6,407,619 | B1 | 6/2002 | Tanaka | |
| 7,250,883 | B2 | 7/2007 | Suzuki | |
| 7,423,476 | B2 | 9/2008 | Tang | |
| 7,705,664 | B2 | 4/2010 | Tang | |
| 7,944,300 | B2 | 5/2011 | Jurasek et al. | |
| 8,829,882 | B2 * | 9/2014 | Willey | 323/315 |
| 2006/0113982 | A1 | 6/2006 | Plojhar | |
| 2010/0141335 | A1 | 6/2010 | Bedeschi et al. | |
| 2011/0204961 | A1 | 8/2011 | Jurasek et al. | |
| 2012/0001663 | A1 | 1/2012 | Willey | |
| 2012/0049817 | A1 | 3/2012 | Willey | |

* cited by examiner

*Primary Examiner* — Jeffrey Sterrett
(74) *Attorney, Agent, or Firm* — Dorsey & Whitney LLP

(57) ABSTRACT

Current circuits, circuits configured to provide a bias voltage, and methods for providing a bias voltage are described, including a current circuit configured to receive a reference current and having an output at which an output current is provided. One such current circuit includes a first current mirror configured to receive a first portion of the reference current and further configured to mirror the first portion of the reference current to provide a first current. The current circuit further includes a second current mirror configured to receive a second portion of the reference current and receive the first current. The second current mirror is further configured to provide a portion of the first current to the output of the current circuit as the output current and to receive another portion of the first current and mirror the same as the second portion of the reference current.

20 Claims, 2 Drawing Sheets

CURRENT GENERATOR CIRCUIT AND METHODS FOR PROVIDING AN OUTPUT CURRENT

CROSS REFERENCE TO RELATED APPLICATION(S)

This application is a continuation of U.S. patent application Ser. No. 12/872,852, filed Aug. 31, 2010, and issued as U.S. Pat. No. 8,829,882 on Sep. 9, 2014. The aforementioned application and patent are incorporated herein by reference, in their entirety, for any purpose.

TECHNICAL FIELD

Embodiments of the invention relate generally to circuits, and mere specifically, in one or more illustrated embodiments, to circuits for venerating an output current.

BACKGROUND OF THE INVENTION

FIG. 1 illustrates a conventional current circuit 100 having a diode coupled n-channel transistor 120 coupled to a capacitor 150 to provide a bias voltage BIAS. A current source 110 is coupled to provide a reference current IREF to the current circuit 100. In operation, the current circuit 100 provides the IOUT current to maintain a stable BIAS voltage on the capacitor 150. For example, where the BIAS voltage is balanced, that is, the BIAS voltage is neither increasing nor decreasing due to the IOUT current, the transistor 120 is biased to conduct a current IO1 that is equal to the IREF current. The IOUT current is 0 for this condition. In the case where BIAS voltage on the capacitor 150 is less than the balanced BIAS voltage, the transistor 120 is made less conductive, and as a result, the IO1 current decreases. The decrease in the IO1 current causes the IOUT current to increase and charge the capacitor 150 to increase the BIAS voltage. As the increasing BIAS voltage returns to the balanced BIAS voltage, the IO1 current increases to be equal to the IREF current, thus the IOUT current no longer charges the capacitor 150. In the case where the BIAS voltage is greater than the balanced BIAS voltage, the transistor 120 is made more conductive and the IO1 current increases. The increase in the IO1 current causes the IOUT current to be drawn from the capacitor thereby discharging it to reduce the BIAS voltage. As the decreasing BIAS voltage returns to the balanced BIAS voltage, the IO1 current decreases to be equal to the IREF current, thus the IOUT current no longer discharges the capacitor 150.

As illustrated in the previous discussion, the current circuit 100 adjusts to provide a stable BIAS voltage. It may be desirable, however, to have alternative current circuits. For example, where reducing power consumption is desirable, providing a current circuit that can be used to provide a BIAS voltage using less current than the conventional current circuit, such as current circuit 100, may be desirable. Another example is where a faster response, that is, the ability for a current circuit 100 to stabilize a BIAS voltage, is desirable, a current circuit providing increased response may be desirable.

DETAILED DESCRIPTION

Certain details are set forth below to provide a sufficient understanding of embodiments of the invention. However, it will be clear to one skilled in the art that embodiments of the invention may be practiced without these particular details. Moreover, the particular embodiments of the present invention described herein are provided by way of example and should not be used to limit the scope of the invention to these particular embodiments. In other instances, well-known circuits, control signals, timing protocols, and software operations have not been shown in detail in order to avoid unnecessarily obscuring the invention.

Figure 2:
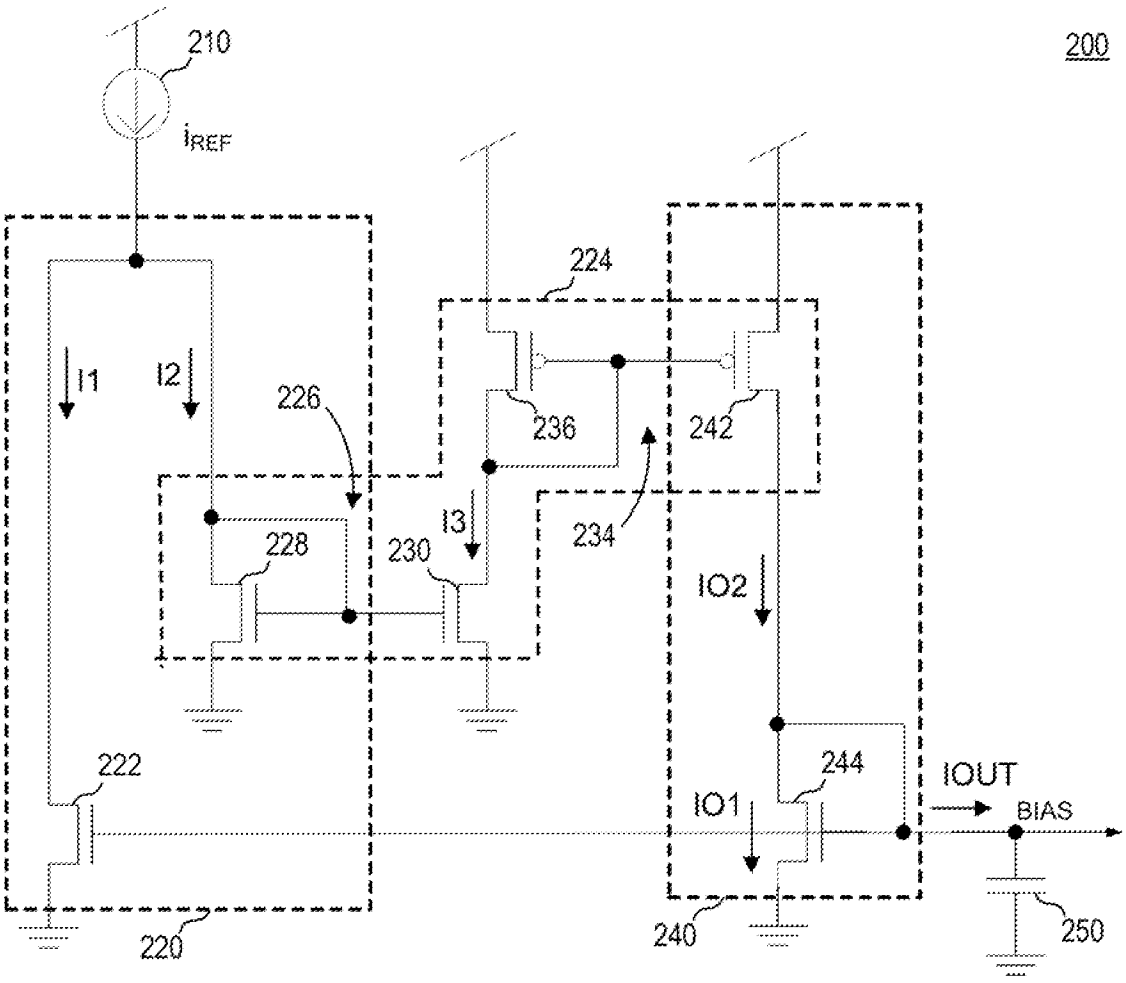
FIG. 2 is a schematic drawing of a current mirror circuit according to an embodiment of the invention.

FIG. 2 illustrates a current generator circuit 200 according to an embodiment of the invention. The current circuit 200 is shown in FIG. 2 as outputting an output current IOUT based on a reference current IREF from a current source 210 to a capacitance (e.g. a capacitor) 250 to provide a bias voltage BIAS. The current circuit 200 includes a current subtraction stage 220 and a current output stage 240. The IREF current is provided to transistors 222 and 228. The IREF current is split into currents I1 and I2. The I2 current is provided to a current mirror stage 224 that overlaps portions of the current subtraction and current output stages 22, 240. The current mirror stage 224 mirrors the I2 current to provide an IO2 current.

In the embodiment shown in FIG. 2, the current mirror stage 224 includes current mirrors 226 and 234. Transistor 230 is coupled to transistor 228 to form current mirror 226. Transistor 236, which along with transistor 242 form current mirror 234, is coupled to transistor 230 to receive a mirrored current I3 of current mirror 226 as an input current to the current mirror 234. The transistor 242 is coupled to diode-coupled transistor 244, which has a gate coupled to a gate of the transistor 222 to form a current mirror. In the embodiment of FIG. 2, transistors 222, 228, 230 and 244 are shown as n-channel transistors (e.g., n-channel field effect transistors (NEET)) and transistors 236 and 242 are shown as p-channel transistors (e.g., p-channel field effect transistors (PFET)). In other embodiments, different types and/or different combinations of transistors may be used. In still other embodiments, n-type and p-type transistors may be switched from that shown in FIG. 2. For example, in other embodiments of the invention transistors 222, 228, 230, and 244 are switched to p-channel transistors and transistors 236 and 242 are switched to n-channel transistors.

In operation, the current subtraction stage 220 is used with the current output stage 240 to adjust the IOUT current, which is based on the IREF current, to provide a balanced BIAS voltage on the capacitor 250. A balanced BIAS voltage is present at the capacitor 250 when currents I1 and I2 of the current subtraction stage 220 are equal. The following examples illustrate operation of the current circuit 200.

The I2 current is mirrored by current mirror 226 to provide the I3 current equal to the I2 current. Likewise, current mirror 234 mirrors the I3 current to the IO2 current. In a first example where a balanced BIAS voltage is present at the capacitor 250, the IO2 current is sunk through transistor 244 as current IO1. That is, IO1=IO2, and consequently, the IOUT current is 0, neither charging nor discharging the capacitor 250. The IO1 current is mirrored through transistor 222 of current mirror 246 so that the I1 current is equal to the IO1 current. Thus, where a balanced BIAS voltage is present at the capacitor 250, I1=I2=I3=IO2=IO1.

When the BIAS voltage at the capacitor 250 is less than the magnitude of the balanced BIAS voltage, the transistor 244 is made less conductive, and as a result, the IO1 current is less than the IO2 current. The difference IO2−IO1 is output as the IOUT current to charge the capacitor 250. The decreased IO1 current is mirrored by transistor 222 to decrease the I1 current. As previously discussed, IREF=I1+I2, or in other terms, I2=IREF−I1. With a constant IREF current, the decrease in the I1 current results in a relative increase in the I2 current. The increased I2 current is mirrored by current mirror 226 to provide an increased I3 current. In turn, current mirror 234 mirrors the increased I3 current as an increased IO2 current. As a result, in addition to the difference IO2–IO1 being output as the IOUT current to charge the capacitor 250, as previously discussed, the IO2 current is also increased to further increase the IOUT current to charge the capacitor 250. The increased IOUT current will diminish as the BIAS voltage approaches the magnitude of the balanced BIAS voltage, and the current circuit 200 returns to the balanced condition of IOUT=0 when the balanced BIAS voltage is reached.

When the BIAS voltage at the capacitor 250 increases to greater than the balanced BIAS voltage, the transistor 244 is made more conductive and the IO1 current increases. The increase in the IO1 current results in discharging the capacitor 250, that is, the IOUT current has a negative polarity to contribute to the IO1 current. The increased IO1 current is mirrored by the transistor 222 to increase the I1 current. The increased I1 current has the effect of decreasing the I2 current into the current mirror 226 (i.e., IO2=IREF–I1, a greater I1 current results in a lesser I2 current). The decreased I2 current is mirrored as a decreased I3 current, which is in turn mirrored through current mirror 234 to, decrease the IO2 current. As a result, in addition to discharging the capacitor due to the increased IO1 current, the IO2 current is also reduced to further increase the discharge current (i.e., negative IOUT current) from the capacitor 250. The discharge current will diminish as the BIAS voltage decreases to the magnitude of the balanced BIAS voltage, and the current circuit 200 returns to the balanced condition of IOUT=0 when the balanced BIAS voltage is reached.

Figure 1:
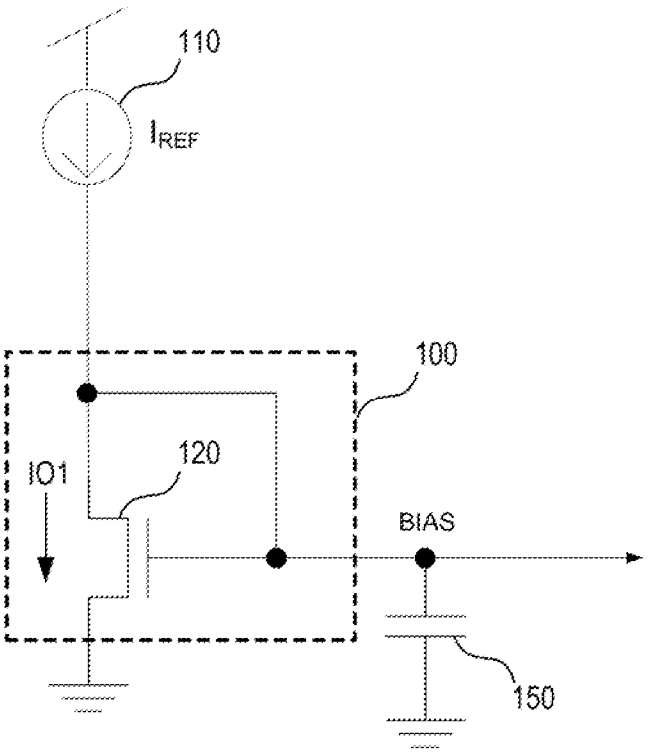
Fig. 1 (prior art)
FIG. 1 is a schematic drawing of a conventional current mirror circuit.

As illustrated by the previous examples, response time of the current circuit 200 to changes in the BIAS voltage may be improved over conventional current circuits, such as current circuit 100 of FIG. 1, due to the increasing and decreasing of the IO2 current, which is a contributor to the charging or discharging current (i.e., IOUT) applied to the capacitor 250.

In some embodiments, the transistors of the current circuit 200 are scaled to scale the IO1 and IO2 currents relative to the IREF current. For example, assuming transistors 222, 228, and 230 have transistor dimensions characterized by "X" and transistor 236 has transistor dimensions characterized by "Y," the IO1 and IO2 currents can be scaled by scaling the dimension of transistors 242 and 244, for example, A*Y for transistor 242 and A*X for transistor 244, where A is a scale factor. Thus, assuming A=10, the magnitude of the IO2 current will be approximately 10 times the magnitude of the I2 current and the magnitude of the IO1 current will be approximately 10 times the magnitude of the I1 current. Although the scaling factor was previously described as being, the same for transistors 242 and 244, this need not be the case and the transistors of the current circuit 200 can be scaled according, to different scaling factors.

From the foregoing it will be appreciated that, although specific embodiments of the invention have been described herein for purposes of illustration, various modifications may be made without deviating from the spirit and scope of the invention. Accordingly, the invention is not limited except as by the appended claims.

What is claimed:

1. An apparatus, comprising:

a first circuit configured to receive first and second input currents and provide an output current to a capacitor to produce an output voltage, the output current based at least in part on the first input current; and a second circuit configured to receive a reference current and provide the first and second input currents based at least in part on the output voltage and the reference current.

2. The apparatus of claim 1, wherein changes in the output voltage affect the first and second input currents.

3. The apparatus of claim 1, wherein the second circuit is configured to divide the reference current into the first and second input currents and provide the second input current to the first circuit through a current mirror circuit.

4. The apparatus of claim 1, wherein the first circuit comprises a diode-connected transistor coupled to the second circuit by a gate and configured to provide the output current to the capacitor.

5. The apparatus of claim 4, wherein the first circuit further comprises a transistor coupled to the diode-connected transistor and coupled to the second circuit through a plurality of current mirrors, and wherein the transistor is configured to provide the second input current to the diode-connected transistor.

6. The apparatus of claim 1, wherein a sum of the first and second input currents is equal to the reference current.

7. A device, comprising:

an input circuit configured to provide first and second input currents, wherein the first and second input currents are relatively adjusted based a value of an output voltage; and an output circuit configured to provide an output current to a capacitor to establish the output voltage, wherein the output current is based on the first and second input currents and wherein changes to the output current adjusts the output voltage.

8. The device of claim 7, wherein the first input current is adjusted based on changes to the output voltage, and the adjustments to the first input current charge or discharge the capacitor to increase or decrease the output voltage, respectively.

9. The device of claim 7, further comprising a current mirror circuit coupled between the input and output circuits and configured to provide the second input current to the output circuit.

10. The device of claim 7, wherein a decrease of the output voltage causes a decrease of the first input current, and wherein a decrease of the first input current causes an increase in the second input current.

11. The device of claim 10, wherein an increase in the second input current causes the output current to charge the capacitor resulting in an increase of the output voltage.

12. The device of claim 7, wherein an increase of the output voltage causes an increase of the first input current, and wherein an increase of the first input current causes a decrease of the second input current.

13. The device of claim 12, wherein a decrease of the second input current causes the output current to discharge the capacitor resulting in a decrease of the output voltage.

14. The device of claim 7, wherein the first input current is provided to the output circuit through a current mirror.

15. The device of claim 7, wherein the second input current is provided to the output circuit through a plurality of current mirrors.

16. The device of claim 7, wherein the first and second input currents are based on a reference current received by the input circuit.

17. A method, comprising:

receiving a reference current at a first circuit;

providing first and second input currents at a second circuit, the first and second input currents based on the reference current;

providing an output current based on the first and second input currents, causing an output voltage to be established across a capacitor; and adjusting the output voltage based at least on changes to the first input current.

18. The method of claim 17, wherein adjusting the output voltage based at least on changes to the first input current comprises:

detecting a decrease of the output voltage;

based on the decrease of output voltage, decreasing the first input current;

based on decreasing the first input current, increasing the second input current; and charging the capacitor to increase the output voltage responsive to the increasing second input current.

19. The method of claim 17, wherein adjusting the output voltage based at least on changes to the first input current comprises:

detecting an increase of the output voltage;

based on the increase of output voltage, increasing the first input current;

based on increasing the first input current, decreasing the second input current; and discharging the capacitor to decrease the output voltage responsive to the decreasing second input current.

20. The method of claim 17, wherein the output voltage is in a balanced condition cause the first input current to equal the second input current.

* * * * *